US010297919B2

(12) United States Patent
Ng et al.

(10) Patent No.: US 10,297,919 B2
(45) Date of Patent: May 21, 2019

(54) DIRECTIVE ARTIFICIAL MAGNETIC CONDUCTOR (AMC) DIELECTRIC WEDGE WAVEGUIDE ANTENNA

(71) Applicant: Raytheon Company, Waltham, MA (US)

(72) Inventors: Jackson Ng, Tucson, AZ (US); Charles G. Gilbert, Tucson, AZ (US); Sergio A. Pizarro, Vail, AZ (US)

(73) Assignee: Raytheon Company, Waltham, MA (US)

( * ) Notice: Subject to any disclaimer, the term of this patent is extended or adjusted under 35 U.S.C. 154(b) by 1136 days.

(21) Appl. No.: 14/472,435

(22) Filed: Aug. 29, 2014

(65) Prior Publication Data

US 2016/0064825 A1 Mar. 3, 2016

(51) Int. Cl.

| | |
|---|---|
| ***H01Q 1/32*** | (2006.01) |
| ***H01Q 13/00*** | (2006.01) |
| ***H01Q 1/27*** | (2006.01) |
| ***H01Q 1/36*** | (2006.01) |
| ***H01Q 1/28*** | (2006.01) |
| ***H01Q 13/24*** | (2006.01) |
| ***H01Q 15/00*** | (2006.01) |

(52) U.S. Cl.

CPC ..... *H01Q 13/00* (2013.01); *H01Q 1/27* (2013.01); *H01Q 1/286* (2013.01); *H01Q 1/364* (2013.01); *H01Q 13/24* (2013.01); *H01Q 15/0086* (2013.01)

(58) Field of Classification Search

CPC .. H01Q 1/1271; H01Q 1/3275; H01Q 1/1278; H01Q 13/18; H01Q 1/12

USPC ..... 343/713, 789, 786, 878

See application file for complete search history.

(56) References Cited

U.S. PATENT DOCUMENTS

| | | | | |
|---|---|---|---|---|
| 2,822,542 A | | 2/1958 | Butterfield | |
| 4,577,196 A | | 3/1986 | Yu | |
| 5,126,751 A | * | 6/1992 | Wada | H01Q 1/286 343/772 |
| 6,496,115 B2 | | 12/2002 | Arakawa | |
| 6,906,676 B2 | | 6/2005 | Killen et al. | |
| 2005/0030241 A1 | * | 2/2005 | Brown | H01Q 13/02 343/786 |

(Continued)

FOREIGN PATENT DOCUMENTS

| | | |
|---|---|---|
| EP | 0 402 005 A2 | 12/1990 |
| EP | 1 538 702 A1 | 6/2005 |

OTHER PUBLICATIONS

Hongyuan et al, Artificial Magnetic Conductor Application_Jan. 2013.*

(Continued)

*Primary Examiner* — Dameon E Levi
*Assistant Examiner* — Collin Dawkins
(74) *Attorney, Agent, or Firm* — Daly Crowley Mofford & Durkee LLP

(57) ABSTRACT

An antenna is provided from a dielectric wedge waveguide having an AMC wall feed structure 15 coupled thereto through a transition which matches the impedance of the AMC feed structure to dielectric wedge so as to ensure efficient transmission of RF signals between the AMC wall feed structure and the dielectric wedge. In some embodiments, the antenna may be implemented as a flush mounted or conformal antenna on an outer surface of a supporting platform.

22 Claims, 9 Drawing Sheets

(56) References Cited

U.S. PATENT DOCUMENTS

| | | | | |
|---|---|---|---|---|
| 2005/0099352 | A1* | 5/2005 | Killen | H01Q 13/02 343/786 |
| 2005/0134522 | A1* | 6/2005 | Waltho | H01Q 1/28 343/909 |
| 2011/0156977 | A1* | 6/2011 | Diaz | H01Q 9/0421 343/772 |

OTHER PUBLICATIONS

Feresidis et al, Artificial Magnetic Conductor Surfaces_Jan. 2013.*
Duochuan et al, IEEE Artificial Magnetic Conductor Technique_Nov. 2008.*
Kehn, et al.; "Moment Method Computation of Miniaturized Rectangular Hard Waveguide with Passband and Stopband;" Antennas and Propagation Society Symposium; IEEE; vol. 2B; Jul. 3, 2005; pp. 630-633; 4 pages.
Li, et al.; "Geometric Characteristics, Physical Mechanism, and Electrical Analysis of Quasi-TEM Waveguides with Dipole-FSS Walls;" Microwave Symposium Digest (MTT); IEEE MTT-S International, May 23, 2010; pp. 17-20; 4 pages.
PCT International Search Report of the ISA for PCT/US2015/034824 dated Feb. 24, 2016; 6 pages.
PCT Written Opinion of the ISA for PCT/US2015/034824 dated Feb. 24, 2016; 7 pages.
Atef Z. Eisherbeni, Editor-in-Chief; "Applied Computational Electromagnetics Society Journal;" vol. 18; No. 1; ISSN 1-54-4887; Mar. 2003; 75 pages.
Chien; "Accurate Analysis of Radiation from Dielectric-Wedge Antenna by Boundary-Element Method based on Guided-Mode Extracted Integral Equations;" IEEE: Electromagnetics in Advanced Applications; ICEAA 2007; Sep. 17-21, 2007; pp. 940-943.
Feresidis, et al.; "Artificial Magnetic Conductor Surfaces and Their Application to Low-Profile High-Gain Planar Antennas;" IEEE Transactions on Antennas and Propagation; No. 53; No. 1; Jan. 2005; pp. 209-215.
Yarovoy, et al.; "The Dielectric Wedge Antenna;" IEEE Transactions on Antennas and Propagation; vol. 50; No. 10; Oct. 2002; pp. 1460-1472.
PCT International Preliminary Report on Patentability for PCT Appl. No. PCT/US2015/034824 dated Mar. 9, 2017; 8 pages.
Response to the communication pursuant to Rules 161(1) and 162 EPC dated Oct. 13, 2017 from European Pat. App. No. 15825871.5; 8 Pages.

* cited by examiner

DIRECTIVE ARTIFICIAL MAGNETIC CONDUCTOR (AMC) DIELECTRIC WEDGE WAVEGUIDE ANTENNA

BACKGROUND

As is known in the art, establishing communication and data links for aircraft, missiles, satellites or other moving or movable vehicles often requires the use of high-bandwidth, high-gain antennas which occupy a small volume. High bandwidths and gains are often needed to satisfy ever increasing requirements for communication distance and data rate. Such antennas are often mounted on a surface (or "skin") of the vehicle and ideally such antennas are flush mounted since flush mounted antennas reduce aerodynamic effects for an underlying vehicle. In some applications, an antenna beam provided by the antenna must generally point in either an aft or forward direction with respect to the vehicle, depending upon the needs of the particular application.

SUMMARY

In accordance with the concepts, systems, circuits and techniques described herein, it has been recognized that there is a need for an antenna that is beam-steered, has high gain, operates over a wide bandwidth, is capable of being flush-mounted, and occupies a small volume (i.e. Is volume-limited). It would, therefore, be desirable to provide an antenna design capable of achieving any combination of the above-described qualities or all of these qualities. In accordance with one aspect of the concepts, systems, circuits, and techniques described herein, an antenna comprises a dielectric wedge waveguide and a waveguide feed structure comprising artificial magnetic conductor (AMC) walls. Thus, the feed waveguide feed structure is also sometimes referred to herein as an AMC wall feed structure.

With this particular arrangement, a dielectric wedge waveguide antenna having an impedance bandwidth which is relatively wide compared with antennas of similar size is provided. The antenna is also provided having end-fire gain and front-to-back ratio characteristics which are relatively high compared with conventional antennas of similar size. By providing the waveguide feed structure having artificial magnetic conductor (AMC) walls, the dielectric wedge waveguide antenna can be packaged in a volume which is less (and often substantially less) than the volume of conventional antennas while at the same time achieving desired antenna characteristics. Specifically, a dispersion relation of the AMC wall feed structure can be designed to reduce (or miniaturize) volume compared with prior art feed structures while maintaining desired operating frequency bandwidth. The AMC wall feed structure couples radio frequency (RF) energy to/from the dielectric wedge waveguide antenna to provide an antenna having a relatively high gain characteristic and a high front-to-back-ratio. Such antennas find use in systems capable of establishing communication and data links where antennas having a relatively high end-fire gain characteristic and a high front-to-back-ratio are desirable. In some embodiments, the illustrative dielectric wedge waveguide may be designed to provide relatively high end-fire gain performance. It should, of course, be appreciated that by adjusting the angle of a dielectric wedge, the antenna pattern may be steered by design to any angle from broadside to end-fire. Also, in some embodiments the front-to-back-ratio may be greater than 15 dB while in other embodiments the front-to-back-ratio may be greater than 20 dB. The particular front-to-back-ratio achieved in any particular application depends upon a variety of factors including, but not limited to, the particular vehicle on which the antenna is mounted or otherwise disposed.

Furthermore, a mobile vehicle or platform which includes a system provided in accordance with the concepts described herein may communicate to a deployment platform by directing an antenna beam (preferably a high gain antenna beam) back to its launch point.

Moreover, by providing the antenna having a relatively small volume, the antenna may be flush mounted to an outer surface of a vehicle thereby reducing, and ideally minimizing, its aerodynamic effect on the vehicle. Furthermore, such a volume-limited antenna can reduce, and ideally minimize, its mass impact on the vehicle (e.g. a smaller antenna may weigh less and consequently reduce the overall weight of a missile, aircraft or other vehicle on which the antenna is mounted). An antenna having a relatively high gain characteristic, a relatively high front-to-back ratio, and which is volume-limited is highly desirable in many applications.

The AMC wall feed structure allows the antenna to be fully recessed (e.g. flush mounted) on a surface of a vehicle. In one illustrative embodiment, the antenna is fully recessed (e.g. flush mounted) on a surface of an airborne vehicle including, but not limited to a missile, an aircraft, an unmanned aerial vehicle (UAV) or other airborne vehicle.

In one embodiment, the AMC feed structure is provided as a rectangular waveguide having an AMC wall. This illustrative embodiment provides a significant reduction in antenna volume compared with conventional designs and provides the antenna having high end-fire gain, high front-to-back ratio (e.g. greater than about 15 dB), wide VSWR 2:1 BW (e.g. greater than about 15%). In one embodiment, an entire antenna assembly comprising an AMC wall feed structure may be recessed into a shroud to reduce, and ideally minimize, aerodynamic impact on an aerial vehicle.

In some embodiments, the AMC wall feed structure utilizes a coaxial line (e.g. having a connector, such as an SMA connector for example, coupled to one end thereof) to provide a port through which RF signals may be provided to/from the antenna. In other embodiments aperture coupling or other techniques may be used to couple RF signals to/from the feed circuits and/or the antenna.

In some embodiments, the antenna may be manufactured using standard printed circuit board (PCB) materials and fabrication processes and thus may be provided as a low cost antenna.

Furthermore the antenna can be scaled using conventional methodologies such that different antennas can be provided for operation over a wide range of different frequency bands.

Simulation and measured results of one illustrative antenna show high end-fire gain, high front-to-back-ratio, and very stable gain response vs. frequency, wide operating impedance bandwidth and compact size. Such characteristics are desirable for datalink systems. The antenna may thus be used in datalink applications requiring high end-fire gain, high front-to-back-ratio and wide impedance bandwidth.

Furthermore, the dielectric wedge antenna-AMC feed assembly has a volume which is relatively small compared with the volume of antenna assemblies having similar electrical antenna characteristics. The small volume of the dielectric wedge antenna assembly allows the antenna to be used on relatively small missile airframes and also allows the antenna to be mounted flush within an outer surface of a mobile or stationary vehicle on which it is disposed (e.g. flush with a missile skin).

The antenna may be used in a wide variety of different applications including, but not limited to: (1) active or passive antenna elements for missile sensor systems; (2) wireless and/or hard-wired datalinks, or communication systems requiring wide impedance bandwidth; (3) applications which require high end-fire gain and/or high front-to-back-ratio; (4) applications requiring an antenna which fits within a compact recessed volume; (5) land-based applications; (6) sea-based applications; (7) satellite communications applications; (8) handheld communication devices; and (9) commercial aircraft communications; (10) satellite digital audio radio services; and (11) medical imaging applications.

Furthermore, the dielectric wedge antenna-AMC feed assembly can be used in handheld communication devices as well as in commercial aircraft communications. Such an assembly also finds use in automobiles for personal communication, cellular signals, traffic updates as well as for emergency response communication.

BRIEF DESCRIPTION OF THE DRAWINGS

The foregoing features may be more fully understood from the following description of the drawings in which.

DETAILED DESCRIPTION

Figure 1:
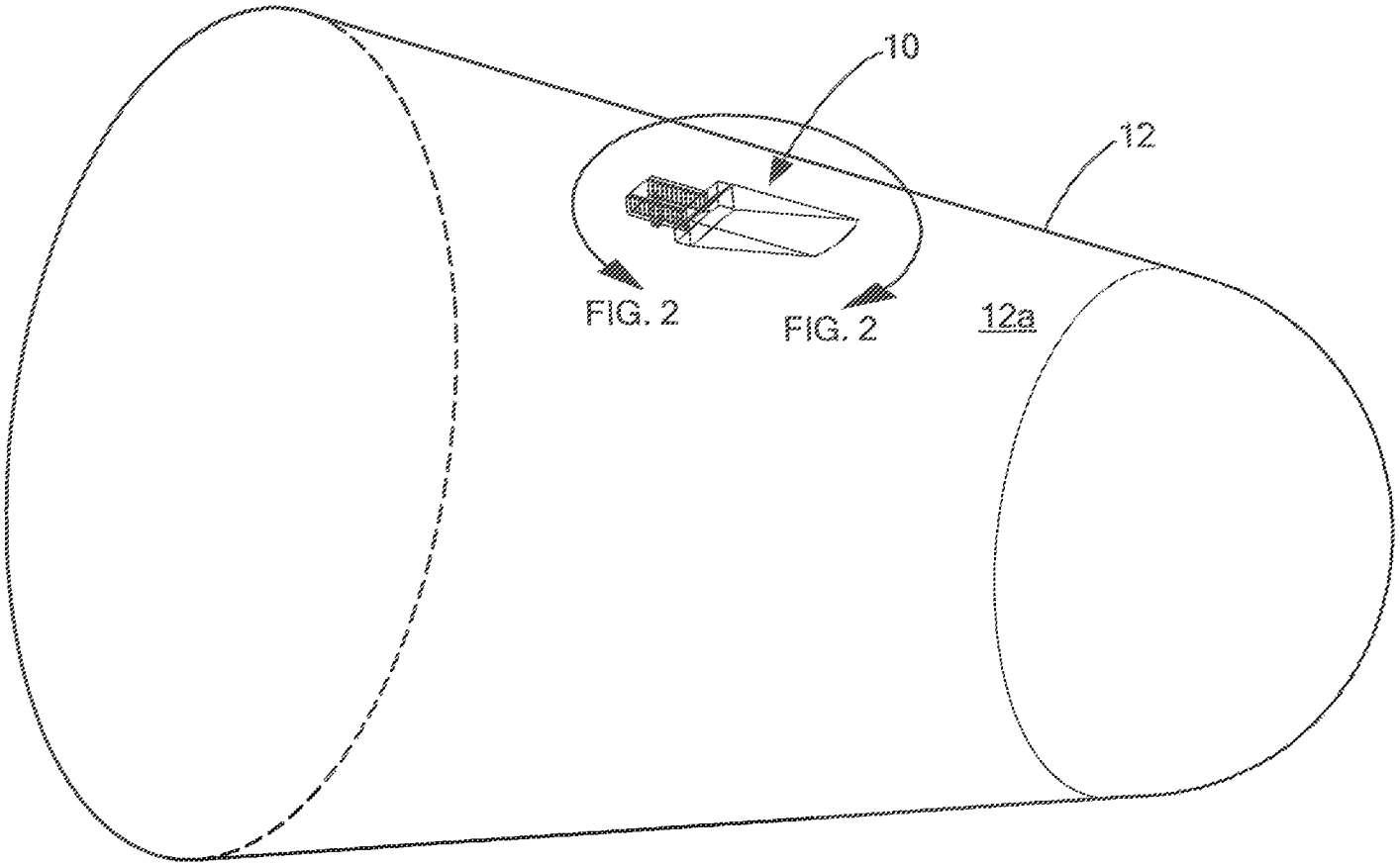
FIG. 1 is an isometric view of a structure having a directive artificial magnetic conductor (AMC) dielectric wedge waveguide antenna disposed thereon.

The subject matter described herein relates to dielectric wedge antenna designs capable of providing antennas having a relatively small, low-profile package while still having relatively high gain, fixed beam steering, wide angular coverage and wide bandwidth characteristics. The antenna designs described herein are particularly well suited for use in applications in which flush mounting of antennas is either desired and/or required (e.g., airborne applications, conformal arrays, etc.). The antenna designs described herein are also well suited for use in other applications where small antenna size is desired, such as hand held wireless communicators and wireless networking products. In some implementations, the antenna designs described herein may be used in wireless or wired datalinks systems.

In the discussion that follows, a right-hand Cartesian coordinate system (CCS) will be assumed when describing the various antenna structures. To simplify description, the direction normal to the face of an antenna will be used as the z-direction of the CCS (with unit vector z), the direction along a longer side of the antenna will be used as the x-direction (with unit vector x), and the direction along a shorter side of the antenna will be used as the y direction (with unit vector y). It should be appreciated that the structures illustrated in the various figures disclosed herein are not necessarily to scale. That is, one or more dimensions in the figures may be exaggerated to, for example, increase clarity and facilitate understanding.

In general overview, described herein is an antenna comprising a feed structure having artificial magnetic conductor (AMC) walls coupled to a dielectric wedge waveguide antenna.

This results in an antenna having a wide impedance bandwidth characteristics, a high end-fire gain characteristic, a high front-to-back ratio (i.e. a measure of antenna directivity), a package within a reduced volume and capable of being flush-mounted on a surface body e.g. a dielectric wedge waveguide antenna with AMC walls feed structure that is fully recessed (or flush-mounted) into a missile skin. With reference to FIG. 5, the front-to-back ratio (FTBR) may be computed as:

$$\mathrm{FTBR}=\mathrm{Gain}_{Theta+0deg}[\mathrm{dB}]-\mathrm{Gain}_{Theta=180deg}[\mathrm{dB}].$$

For example, a isotropic source would have a FTBR=0 dB.

Use of an AMC wall feed structure significantly reduces the volume of the antenna. In some embodiments, for the same application, the volume is reduced by a factor of 2.6 compared with conventional designs.

While one illustrative combination of an AMC wall feed structure and a dielectric wedge waveguide antenna is described, it should be understood that many other variants and combinations based upon the basic concept exists as well and after reading the disclosure provided herein, a person of ordinary skill in the art will understand how to provide an antenna having an AMC wall feed structure and as well as desired antenna characteristics.

Referring now to FIG. 1, an antenna 10 is mounted (or otherwise disposed) on a platform (or vehicle) 12. As will be described in detail below, antenna 10 comprises an AMC wall feed structure coupled to a dielectric wedge antenna. In the illustrative example of FIG. 1, platform 12 is provided as a portion of a missile body. Thus antenna 10 may correspond to a rear reference antenna or a fuse antenna, for example.

It should be appreciated, and as noted above, antenna 10 finds use in many applications other than missile applications. Thus, in other applications, platform 12 may also correspond to an aircraft body or any stationary or moving (or movable) platform.

Accordingly, it should also be appreciated that although in FIG. 1 platform 12 is shown having a generally conical shape, in general, platform 12 may be provided having any size and/or shape (e.g. cylindrical or any other geometric shape) selected to suit the needs of any particular application (including, but not limited to, a cylindrical shape, a box shape, a prism shape, a pyramidal shape with any of such shapes having flat or curved surfaces).

In the illustrative embodiment of FIG. 1, antenna 10 is provided in a relatively small physical package having a relatively small volume which allows the antenna 10 to be mounted flush with respect to a surface of an outer covering 12*a* (or "skin") of the platform 12 (e.g. a missile or other vehicle) in airborne applications, flush mounted antennas reduce, and ideally minimize, aerodynamic effects for an underlying moving platform. A volume-limited antenna can reduce or ideally minimize mass impact (that is, a smaller antenna may weigh less and consequently reduce the overall weight of the missile or aircraft in which it is mounted).

As will be described in detail further below, antenna 10 is provided from an AMC wall feed structure coupled to a dielectric wedge waveguide antenna. This results in antenna 10 having a wide bandwidth characteristic, good directionality and a high gain characteristic which help satisfy ever increasing requirements for communication distance and data rate.

In one illustrative operating scenario, the antenna 10 is mounted on a missile body and communicates to a deployment platform (e.g. a missile launch point, not shown in FIG. 1). To accomplish this, the antenna gain must be directed toward its launch point (i.e. the antenna beam must be generally rearward facing with respect to the direction of missile travel).

To use antenna 10 on a missile (or other airborne vehicle) and operate for all data link functions, it is desirable for the antenna 10 to have a high end-fire gain characteristic, a high front-to-back-ratio, a wide impedance bandwidth characteristic, and also be volume-limited and capable of being flush-mounted with the missile skin.

It should, of course, be appreciated that the antenna 10 may be used in a wide variety of different applications including, but not limited to: (1) active or passive antenna elements for missile sensor system; (2) wireless and/or hard-wired data links, or communication systems requiring wide impedance bandwidth; (3) high end-fire gain, high front-to-back-ratio, and applications requiring a compact recessed volume; (4) land-based applications; (5) sea-based applications; (6) satellite communications applications; (7) handheld communication devices; and (8) commercial aircraft communications; (9) satellite digital audio radio services; and (10) medical imaging.

Figure 2:
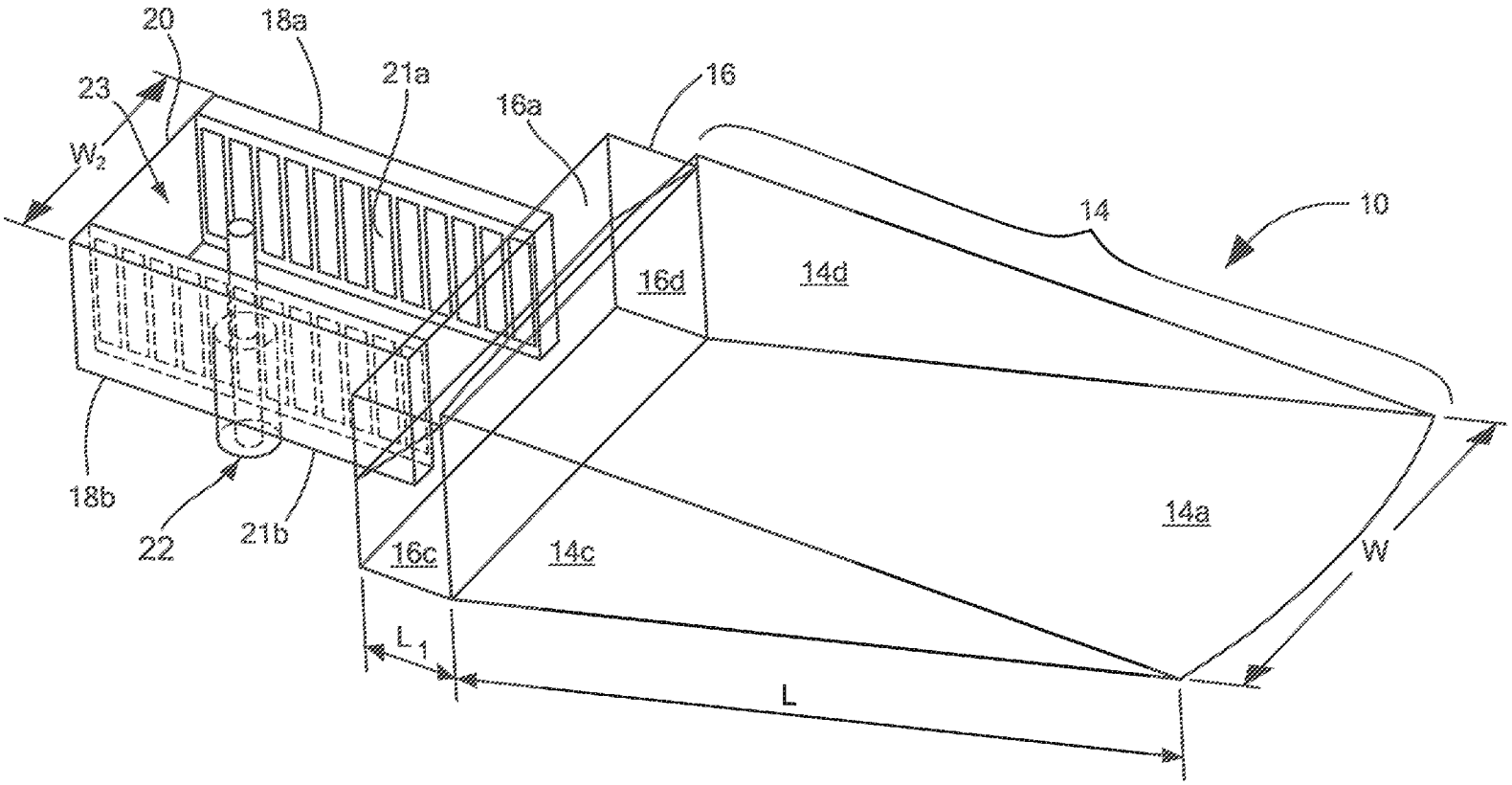
FIG. 2 is a front isometric view of the directive artificial magnetic conductor (AMC) dielectric wedge waveguide antenna of FIG. 1.
Figure 2A:
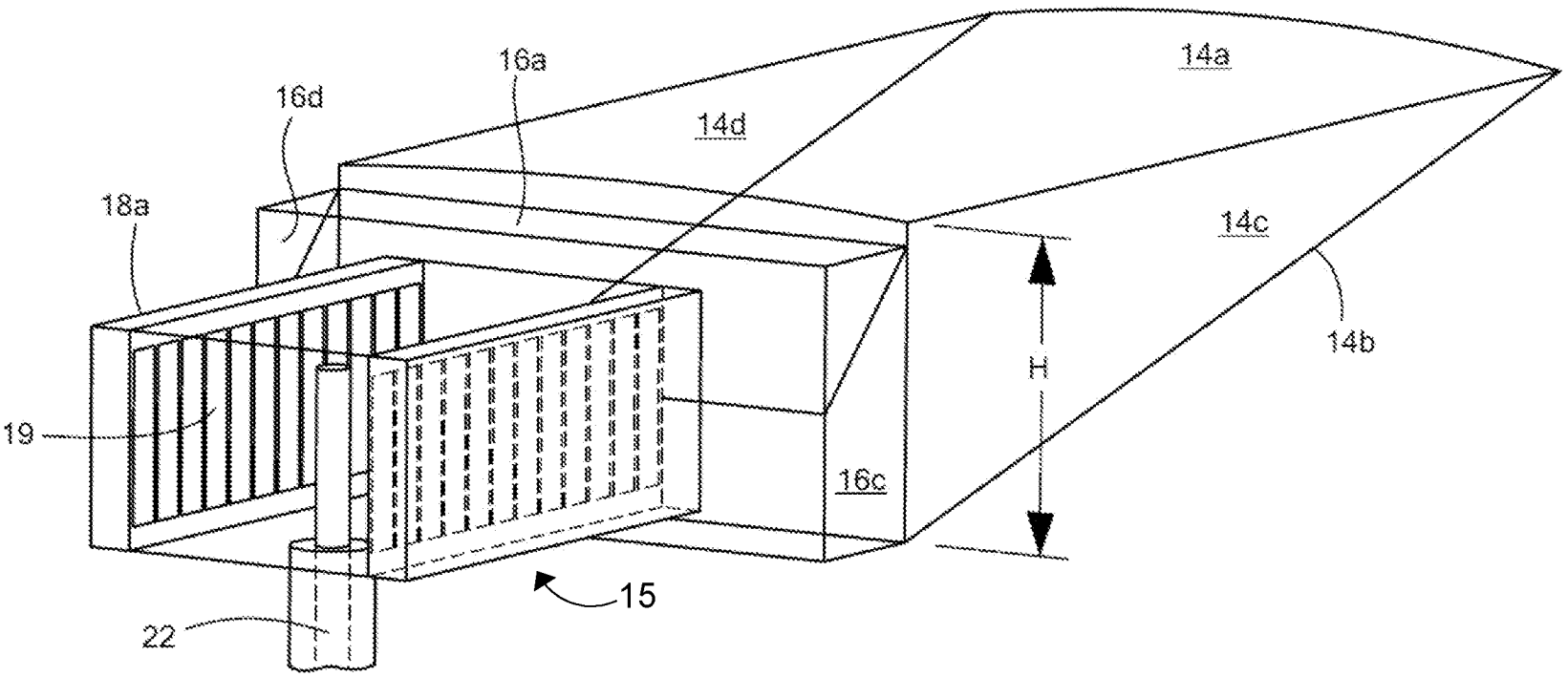
FIG. 2A is a rear isometric view of the directive AMC dielectric wedge waveguide antenna of FIG. 1.
Figure 2B:
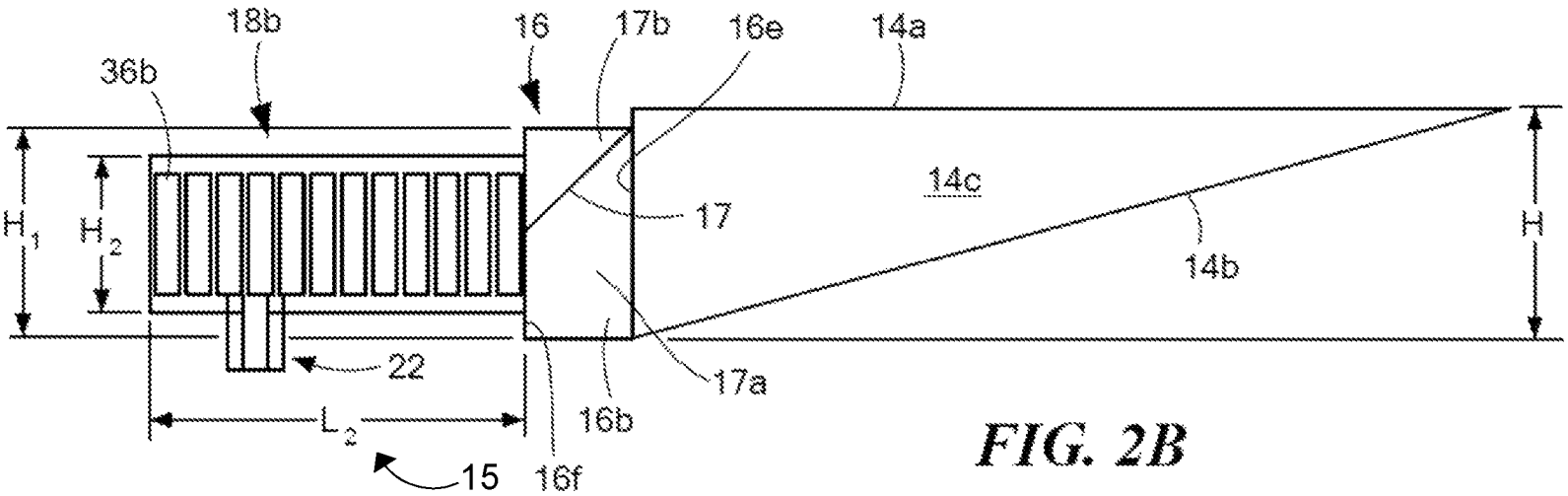
FIG. 2B is a side view of the directive AMC dielectric wedge waveguide antenna of FIG. 1.

Referring now to FIGS. 2-2B in which like reference elements are provided having like reference designations, antenna 12 is provided from a dielectric wedge waveguide 14 (also sometimes referred to as "dielectric wedge 14" or more simply "wedge 14") having an AMC wall feed structure 15 coupled thereto through a transition 16 (e.g. an impedance transformer to match the impedance of the AMC feed structure 15 to dielectric wedge 14 so as to ensure efficient transmission of RF signals between the feed 15 and the dielectric wedge 14).

For reasons which will become apparent from the description provided herein below, providing the antenna having an AMC walls feed structure and a rectangular waveguide shape reduces both the length and width of the feed compared with a length and width required by conventional waveguide feed circuits for the same application. Consequently, use of the AMC walls feed structure reduces, and in some cases significantly reduces, the volume required to feed the dielectric wedge 14. In some embodiments, the volume is reduced by more than a factor of about 2 compared with the volume of conventional antenna designs. In some embodiments, the volume is reduced by a factor of about 2.6 compared with the volume of conventional antenna designs.

Dielectric wedge 14 may be provided from any organic or inorganic material having desired physical (e.g. mechanical) and electrical properties (e.g. relative dielectric constant, permittivity, etc. . . . ). In the illustrative embodiment of FIGS. 2-2B, dielectric wedge 14 is provided having top and bottom surfaces 14*a*, 14*b*, side surfaces 14*c*, 14*d* as well as a length L, a width W and a height H. Surfaces 14*b*, 14*c*, 14*d* are electrically conductive (e.g. by having a conductive material disposed or otherwise provided thereon). The length L, width W and height H of dielectric wedge 14 are selected in accordance with a variety of factors, including but not limited to the physical and electrical characteristics of the wedge as well as a desired operating frequency to meet the requirements of a particular application. Those of ordinary skill in the art will understand how to select an appropriate wedge material and wedge dimension to achieve desired electrical and mechanical characteristics for a particular application.

Transition 16 comprises a dielectric portion 17*a* having a conductive material disposed or otherwise provided thereon. Dielectric 17*a* (FIG. 2B) is provided having a shape such that region 17*b* (FIG. 2B) of transition 16 is air-filled. The angle of surface 17 (FIG. 2B) is selected to help provide a desired impedance match between RF signals propagating between feed structure 15 and wedge 14. As with dielectric wedge 14, the dielectric portion 17*a* of transition 16 may be provided from any organic or inorganic material having desired physical (e.g. mechanical) and electrical properties (e.g. relative dielectric constant, permittivity, strength characteristics of the material, operating frequency, etc. . . . ).

In the illustrative embodiment of FIGS. 2-2B, transition 16 is provided having top and bottom surfaces 16*a*, 16*b*, side surfaces 16*c*, 16*d*, front and back surfaces 16*e*, 16*f* as well as a length L1, a width W1 (which in this illustrative embodiment is equal to width W) and a height H1 (FIG. 2B). Portions of surfaces 16*a*, 16*c*, 16*d* are electrically conductive (e.g. by having a conductive material disposed or otherwise provided thereon). The length L1, width W1 and height H1 of transition 16 are selected in accordance with a variety of factors, including but not limited to the physical and electrical characteristics of the wedge 14 and feed structure 15 as well as a desired operating frequency to meet the requirements of a particular application. Those of ordinary skill in the art will understand how to select a transition having appropriate electrical and mechanical characteristics to match the impedance of the AMC feed structure 15 to dielectric wedge 14 so as to ensure efficient (e.g. low-loss) transmission of RF signals between the feed 15 and the dielectric wedge 14.

Although transition 16 is here implemented using a particular structure, those of ordinary skill in the art will appreciate that any transition or structure capable of appropriately matching the impedance of AMC feed section 15 to the impedance of wedge 14 may be used. Those of ordinary skill in the art will appreciate that there are many ways (i.e. a wide variety of techniques and structures) to implement such a transition.

AMC feed structure 15 is provided from first and second side walls 18*a*, 18*ba* which are disposed against a surface 16*f* of transition 16. A conductive end wall 20 is disposed against second ends of first and second side walls 18*a*, 18*ba* and top and bottom walls 21*a*, 21*b* are also disposed over top and bottom edges, respectively, of side walls 18*a*, 18*b* to thus form a waveguide cavity 22. A center conductor portion of a coaxial line 23 projects into the cavity 22 to thus provide a feed through which RF signals may be coupled into and out of the cavity 22. It should, of course, be appreciated that although a vertical coaxial line is here shown to feed the waveguide in the illustrative embodiment of FIGS. 2-2B, other waveguide feeds (including, but not limited to aperture coupled feeds) may also be used.

In the illustrative embodiment described herein, the waveguide is thus provided as a rectangular waveguide having an AMC walls feed structure. In some embodiments, the waveguide may be provided as an air-filled waveguide, a dielectric filled waveguide or a partially dielectrically filled waveguide.

In the illustrative embodiment of FIGS. 2-2B, AMC feed structure 15 is provided having a length L2, a width W2 and a height H2. The length L2, width W2 and height H2 of transition 16 are selected in accordance with a variety of factors. In the illustrative embodiment described herein, for example, the following parameters were used as design parameters to design the dispersion relation of the AMC feed structure, that is, to reduce the cut-off frequency of the miniaturized waveguide to be below the desired operation frequency: width of waveguide, length of waveguide, height of waveguide, dielectric constant of waveguide (in this case air), dielectric constant of AMC side wall, thickness of AMC sidewall, width of copper trace of AMC sidewall, length of copper trace of AMC sidewall, and finally the number of AMC cells, (in the illustrative example of FIGS. 2-2B, twelve cells were used). An eigenmode solver of a commercially available computational electromagnetic solver, (e.g. High Frequency Structure Simulator or HFSS from Ansys) was used to compute the dispersion relation. Each of the above parameters were then optimized to provide the desired dispersion relation.

In one embodiment, the width and a height of the dielectric wedge are each less than a wavelength at the center frequency of the antenna. In one illustrative embodiment for operation in the X-band frequency range, the dielectric wedge is provided having a length corresponding to about 1.2λ, a width corresponding to about 0.7λ, and a height corresponding to about 0.3λ at a center frequency of the antenna. In other frequency ranges, the dimensions may differ from that described above. It has been found that the length of the wedge could be made shorter depending on how much steering one desires. It has also been found that making the length of the wedge longer than about 1.2λ was found to not increase the amount of steering while making the length of the wedge shorter than 1.2λ resulted in not quite as much steering.

In one embodiment, a length, width and height of the AMC wall feed structure are each less than a wavelength at the center frequency of the antenna. In one illustrative embodiment for operation in the X-band frequency range, the AMC wall feed structure is provided having a length corresponding to about 0.5λ, a width corresponding to about 0.4λ, and a height corresponding to about 0.2λ at a center frequency of the antenna. In other frequency ranges, the dimensions may differ from that described above. It was found that the length could be further optimized, but to achieve such optimization a trade-off must be made with respect to performance. The same is true with respect to the width. For example, it was found that it is possible to provide an AMC wall feed structure having a width which is less than that described above, but that doing so results in an antenna having a reduced bandwidth.

In one embodiment, a length and width of the transition is less than a wavelength at the center frequency of the antenna. In one illustrative embodiment for operation at X-band frequency range, a length of the transition corresponds to about 0.15λ and a width of the transition matches the width of the dielectric wedge at a center frequency of the antenna.

It should be appreciated that the above dimensions are only one example for use in the X-band frequency range and that other dimensions may be appropriate for use in other frequency ranges.

Figure 3:
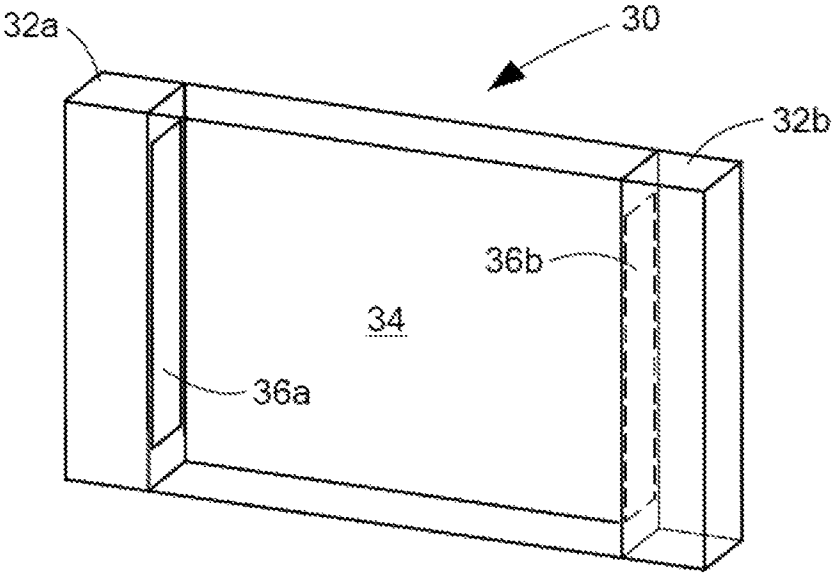
FIG. 3 is a perspective view of a portion of the directive AMC dielectric wedge waveguide antenna of FIGS. 2-2B.

As may be most dearly visible in FIG. 3, in which like elements of FIGS. 2-2B are provided having like reference designations, sidewalls 18*a*, 18*b* comprise a plurality of periodic magnetic conductor sections 30 (also referred to as "unit cell sections 30" or more simply "unit cells 30"). Each unit cell 30 comprises a pair of sidewall portions 32*a*, 32*b* having AMC portions 34*a*, 34*b* embedded or otherwise provided therein. The walls are spaced by a region 34 which may be provided as an air-filled region, a dielectric filled region or a partially dielectrically filled region.

In the illustrative embodiment, the unit cell may be fabricated using conventional printed circuit board technology. For example, a dielectric board 32*a*, 32*b* (e.g. of the type manufactured by Rogers Corporation, for example) having a conductive material 36*a*, 36*b* (e.g. copper or other suitable conductor) disposed on at least one surface thereof with the conductor disposed (e.g. by etching, pattering or via any other subtractive or additive technique well-known to those of ordinary skill in the art) to provide a periodic pattern may be used. The opposite surface of the board is substantially free of any conductive material.

The AMC sidewalls 32*a*, 32*b* are specifically designed to reduce the cut-off frequency to be below the desired operating frequency of a miniaturized waveguide. The number of unit cells, (e.g. 12), was empirically determined through simulation and selecting a balance of impedance bandwidth, front-to-back-ratio, and physical length appropriate for a desired application.

Figure 4:
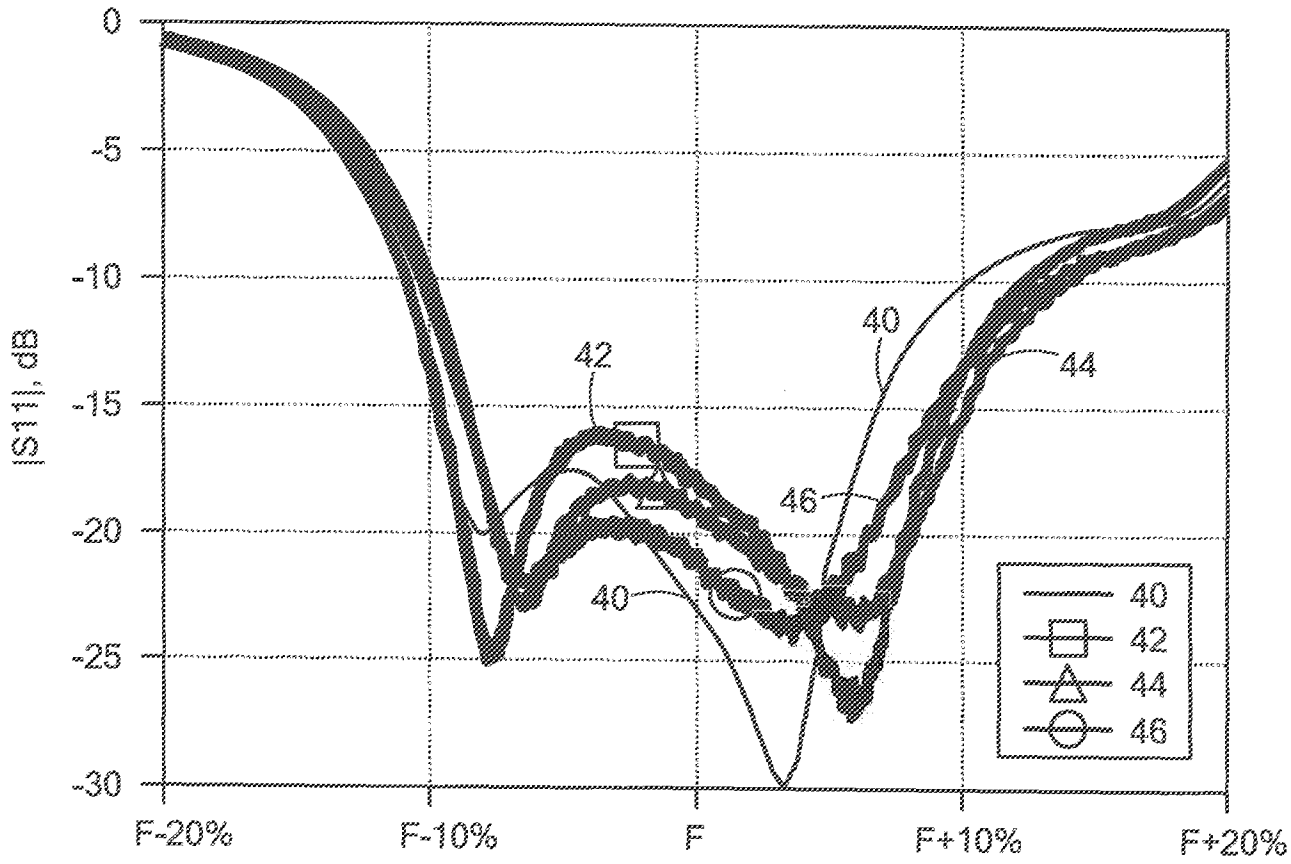
FIG. 4 is a plot of measured input reflection coefficient vs. frequency recorded for a directive AMC dielectric wedge waveguide antenna which may be the same as or similar to that shown in FIGS. 1-3.

Referring now to FIG. 4, a plot of input reflection coefficient (S11) of an illustrative antenna design shows that a wide impedance bandwidth is achieved in the antenna achieving a return loss greater than about 15 db over about a 16% frequency bandwidth and a return loss greater than about 17.5 db over about a 10% frequency bandwidth. Curve 40 is provided from simulated data while curves 42-26 are provided from measured data.

Figure 5A:
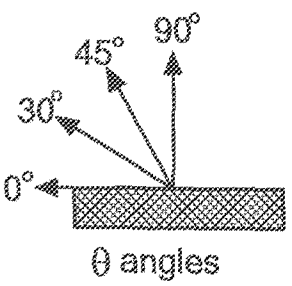
FIG. 5 is a plot of measured gain vs. angle which compares gain characteristics of a patch antenna and three prototype AMC dielectric wedge waveguide antennas over variety of azimuth angles above horizon (FIG. 5A)
Figure 5:
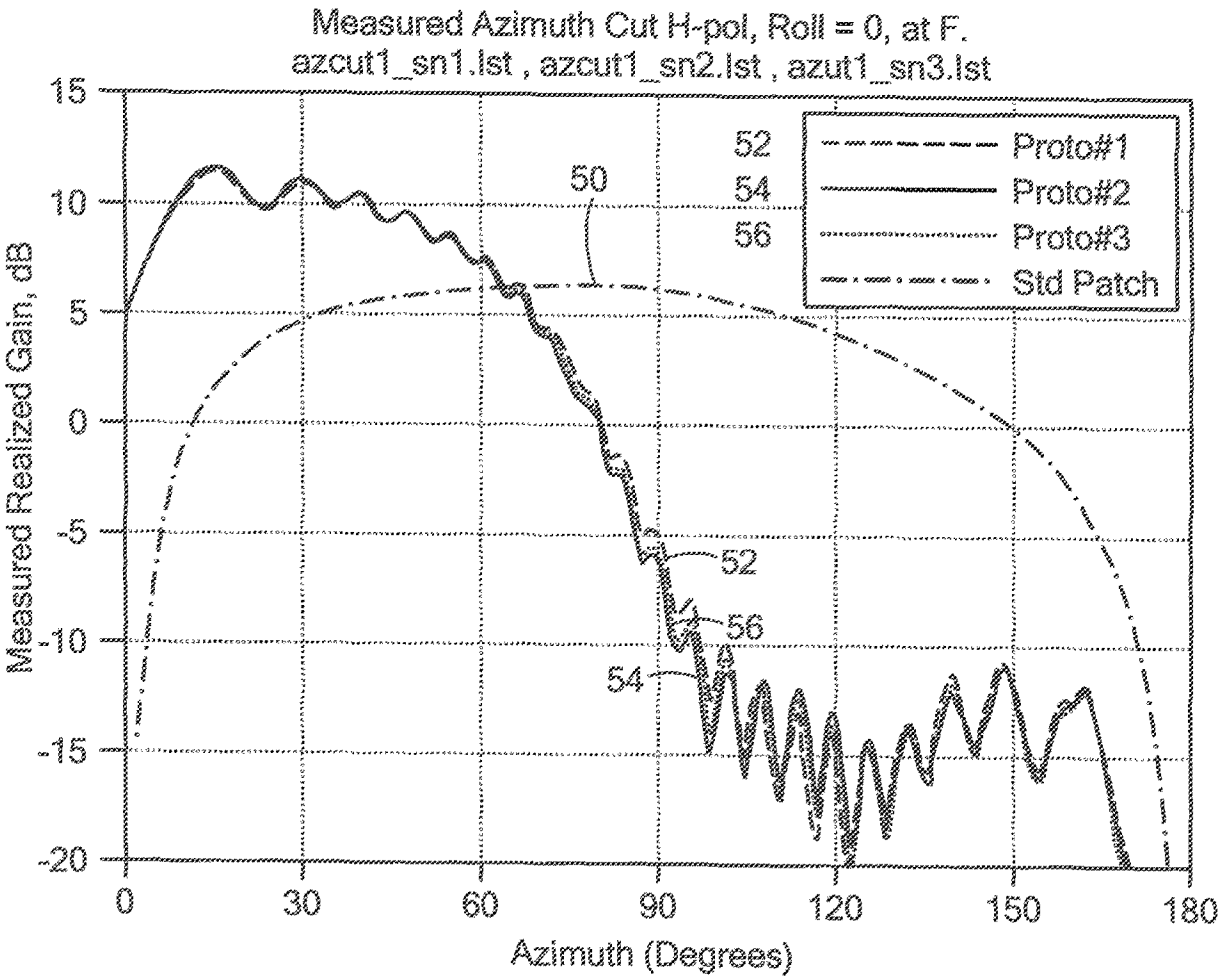

Referring now to FIGS. 5 and 5A, a plot of measured realized gain for a standard patch antenna (curve 50) and three different dielectric wedge waveguide antenna designs (curves 52-56) is shown. As can be seen from FIG. 5, the AMC wall feed antenna has an end-fire gain and front-to-back ratio, which is relatively high compared to end-fire gain and front-to-back ratios of traditional designs.

Figure 6A:
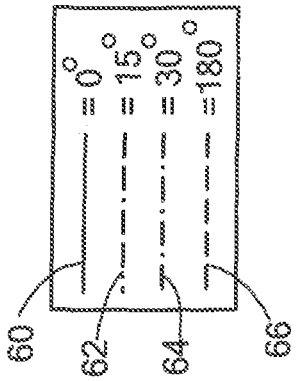
FIG. 6 is a plot of measured realized gain versus frequency at azimuth angles of −90, +60, +75, and +90 degrees above horizon (FIG. 6A) for an illustrative directive AMC dielectric wedge waveguide antenna which may be the same as or similar to that shown in FIGS. 1-3.
Figure 6A:
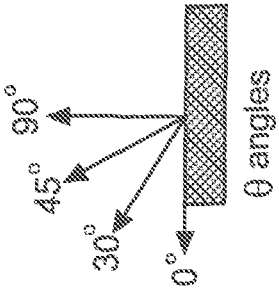
Figure 6:
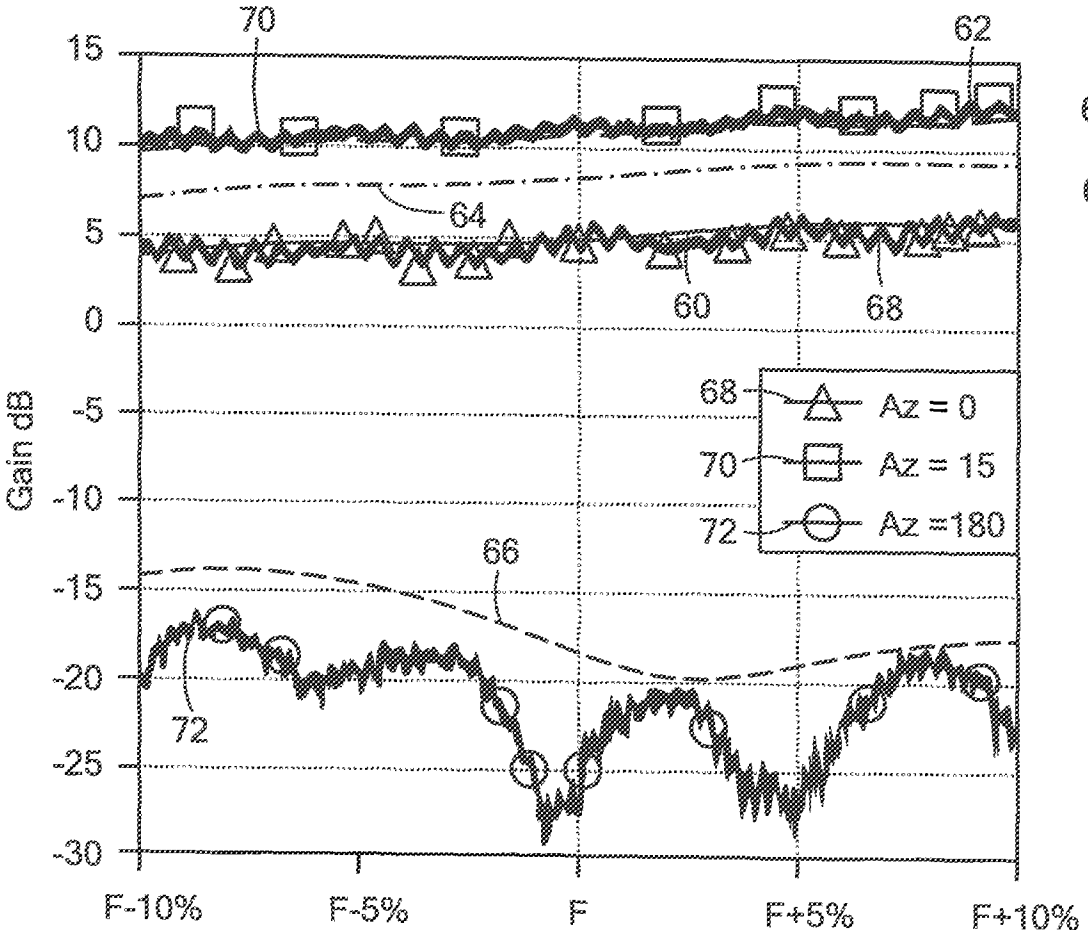

FIG. 6 is a plot of both simulated and measured antenna gain vs. frequency in four different azimuth planes (0 degrees, +15 degrees, +30 degrees and +180 degrees) for an illustrative antenna design. The simulated results are shown over a 20 percent frequency range. Curves 60-646 correspond to simulated data while curves 68-72 correspond to measure data. The plot shows that over a desired frequency range, the antenna provides very stable high end-fire gain and high front to back ratio vs. frequency.

Figure 7:
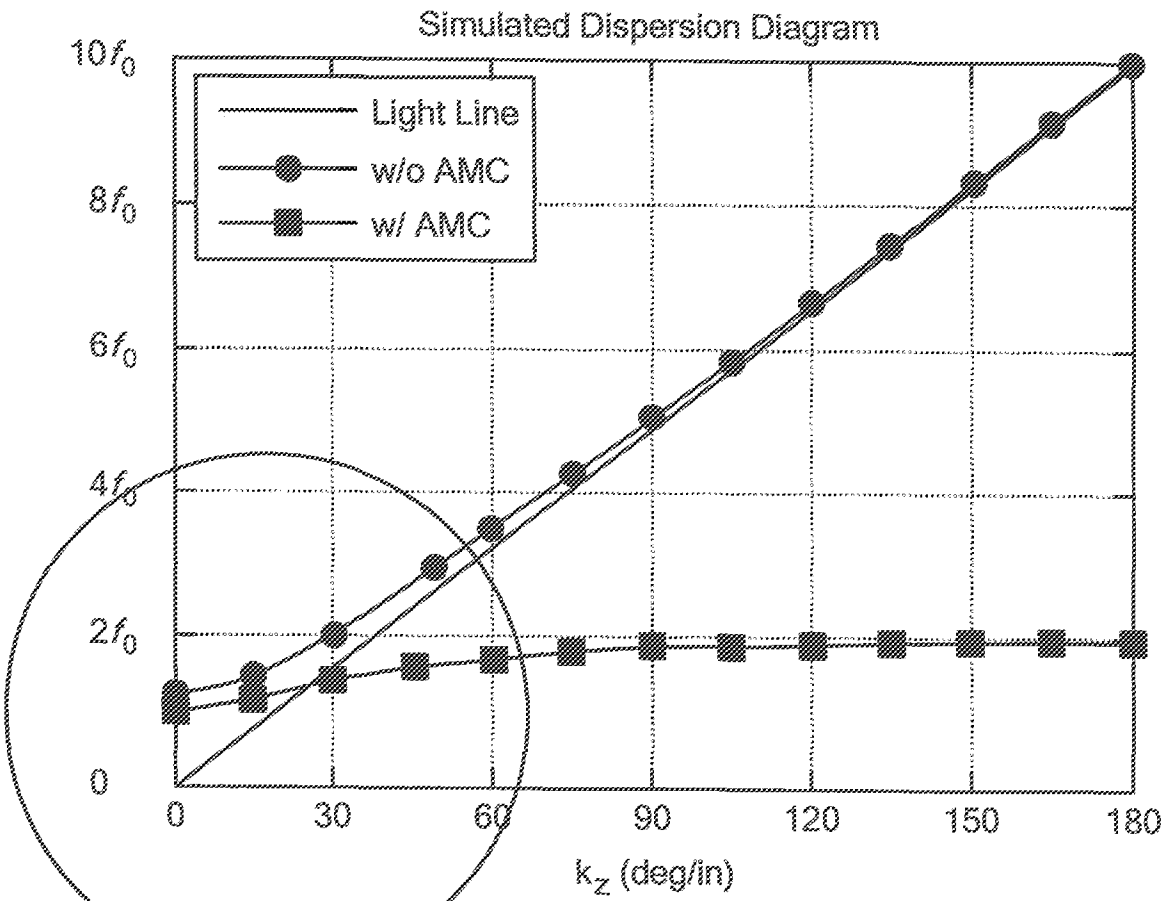
FIG. 7 is a plot of simulated dispersion relation of the AMC wall feed structure with wavenumber (degrees/in) vs. Frequency.
Figure 7A:
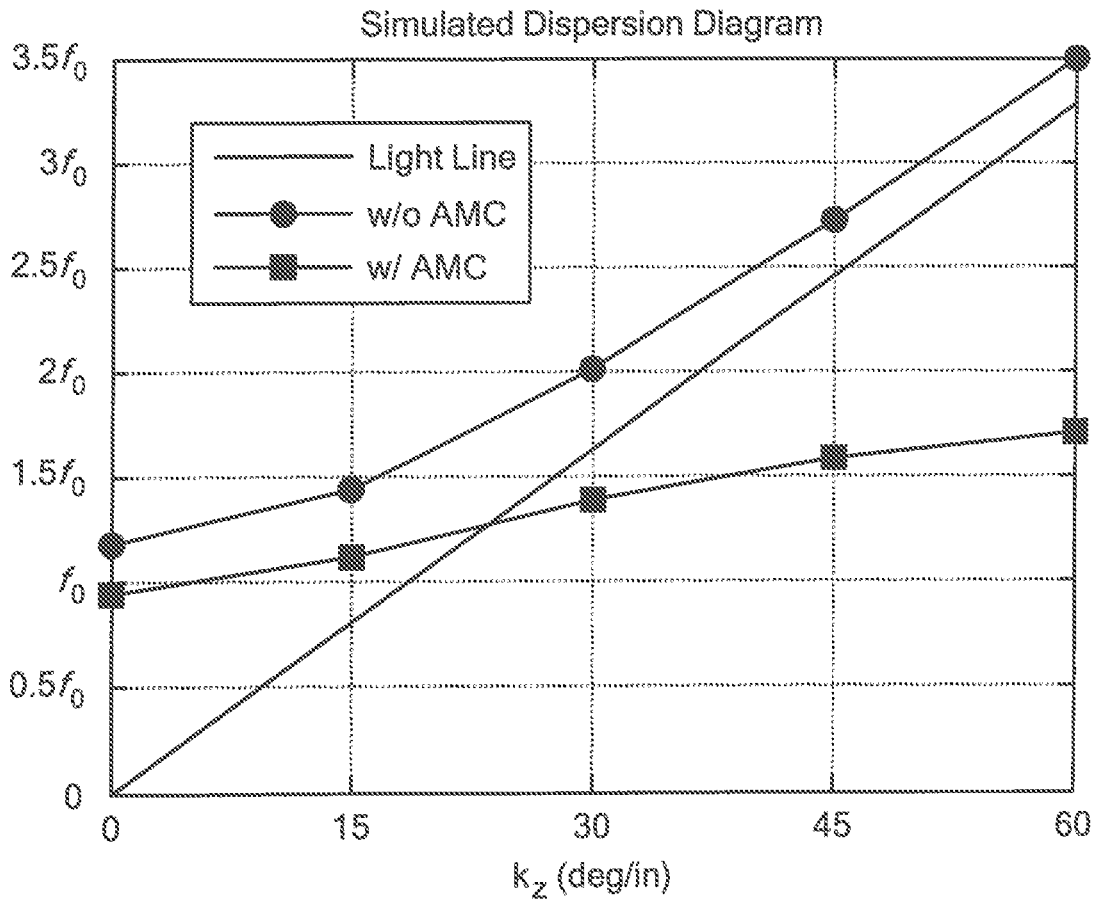
FIG. 7A is an expanded view of a portion of the plot of FIG. 7 taken across lines 7A-7A of FIG. 7.

Referring now to FIGS. 7 and 7A, illustrate a simulated dispersion diagram which conveys, to one of ordinary skill in the art, an understanding of how to design dispersion relation. Specifically, a dispersion relation of the AMC wall feed structure can be designed to reduce (or miniaturize) volume compared with prior art feed structures while maintaining desired operating frequency bandwidth. FIG. 7 shows the final design of the dispersion relation of the AMC wall feed structure described above in conjunction with FIGS. 2-2B.

As described previously, in some embodiments, the mounting surface 112 may be the exterior skin of a vehicle or other mounting platform. The antenna assemblies 10 may be flush mounted within the various cavities to reduce problems related to, for example, wind drag. In some embodiments, however, flush mounting is not used. One or more beamformers may be coupled to the various antenna assemblies for use in forming beams using the various antenna elements.

The techniques and structures described herein may be used, in some implementations, to generate conformal antennas or antenna arrays that conform to a curved surface on the exterior of a mounting platform (e.g., a missile, an aircraft, etc.). When used in conformal applications, the structures described above can be re-optimized for a conformal cavity. Techniques for adapting an antenna design for use in a conformal application are well known in the art and typically include re-tuning the antenna parameters for the conformal surface.

The antenna designs and design techniques described herein have application in a wide variety of different applications. For example, the antennas may be used as active or passive antenna elements for missile sensors that require bandwidth, higher gain to support link margin, and wide impedance bandwidth to support higher data-rates, within a small volume. They may also be used as antennas for land-based, sea-based, or satellite communications. Because antennas having small antenna volume are possible, the antennas are well suited for use on small missile airframes. The antennas may also be used in, for example, handheld communication devices (e.g., cell phones, smart phones, etc.), commercial aircraft communication systems, automobile-based communications systems (e.g., personal communications, traffic updates, emergency response communication, collision avoidance systems, etc.), Satellite Digital Audio Radio Service (SDARS) communications, proximity readers and other RFID structures, radar systems, global positioning system (GPS) communications, and/or others. In at least one embodiment, the antenna designs are adapted for use in medical imaging systems. The antenna designs described herein may be used for both transmit and receive operations. Many other applications are also possible.

Having described exemplary embodiments of the invention, it will now become apparent to one of ordinary skill in the art that other embodiments incorporating their concepts may also be used. The embodiments described herein should not be limited to disclosed embodiments but rather should be limited only by the spirit and scope of the appended claims. All publications and references cited herein are expressly incorporated herein by reference in their entirety.

What is claimed is:

1. An antenna comprising:

a dielectric wedge waveguide;

an artificial magnetic conductor (AMC) wall feed structure having a pair of sidewalls, each of said sidewalls comprising a plurality of unit cells each having AMC portions provided therein; and a transition coupled between said AMC wall feed structure and said dielectric wedge waveguide;

wherein:

each of said unit cells is spaced apart by a predetermined distance with a region between the sidewall pairs;

said AMC wall feed structure further comprising:

a top conductive wall disposed over a top surface of said pair of sidewalls;

a bottom conductive wall; and a conductive end wall wherein said top, bottom, end and side walls form a waveguide being open on one end exposed to said transition.

2. The antenna of claim 1, wherein: a width and a height of said dielectric wedge are each less than a wavelength at the center frequency of the antenna.

3. The antenna of claim 1, wherein said dielectric wedge is provided having a length corresponding to about 1.2λ, a width corresponding to about 0.7λ, and a height corresponding to about 0.3λ, wherein λ is a wavelength at a center frequency of the antenna.

4. The antenna of claim 1, wherein: a width and a height of said AMC wall feed structure are each less than a wavelength at the center frequency of the antenna.

5. The antenna of claim 1, wherein said AMC wall feed structure is provided having a length corresponding to about 0.5λ, a width corresponding to about 0.4λ, and a height corresponding to about 0.2λ, wherein λ is a wavelength at a center frequency of the antenna.

6. The antenna of claim 1 wherein each unit cell comprises a pair of sidewall portions having the AMC portions provided therein and is spaced apart by a predetermined distance.

7. The antenna of claim 6 wherein said AMC wall feed structure comprises:

regions between the sidewall portions provided as a dielectric filled region.

8. The antenna of claim 6 wherein said AMC wall feed structure comprises:

regions between the sidewall portions;

a top conductive wall disposed over a top surface of said pair of sidewalls;

a bottom conductive wall; and a conductive end wall wherein said top, bottom, end and side walls form a waveguide being open on one end exposed to said transition.

9. The antenna of claim 8 wherein said transition comprises:

a conductive cavity defined by sidewalls and a bottom surface, the conductive cavity having a dielectric material disposed in at least a portion thereof and being open on a first end facing said AMC wall feed structure and open on a second, opposite end facing said dielectric wedge.

10. The antenna of claim 1, wherein said AMC wall feed structure comprises a feed probe disposed in a center of the bottom conductive wall of said waveguide.

11. The antenna of claim 10, wherein: a width and a height of said dielectric wedge are each less than a wavelength at the center frequency of the antenna.

12. The antenna of claim 11, wherein said dielectric wedge is provided having a length corresponding to about 1.2λ, a width corresponding to about 0.7λ, and a height corresponding to about 0.3λ, wherein λ is a wavelength at a center frequency of the antenna.

13. The antenna of claim 12, wherein: a width and a height of said AMC wall feed structure are each less than a wavelength at the center frequency of the antenna.

14. The antenna of claim 13, wherein said AMC wall feed structure is provided having a length corresponding to about 0.5λ, a width corresponding to about 0.4λ, and a height corresponding to about 0.2λ, wherein λ is a wavelength at a center frequency of the antenna.

15. The antenna of claim 1, wherein:

the antenna is configured for insertion into a conductive cavity within an outer skin of a vehicle; and the dielectric wedge has a height that allows the antenna to be mounted in the conductive cavity substantially flush to the outer skin of the vehicle.

16. The antenna of claim 15, wherein the vehicle includes one of: a ground vehicle, a watercraft, an aircraft, and a spacecraft.

17. The antenna of claim 16, wherein: a width and a height of said AMC wall feed structure are each less than about a wavelength at the center frequency of the antenna.

18. The antenna of claim 15, wherein said dielectric wedge is provided having a length corresponding to about 1.2λ, a width corresponding to about 0.7λ, and a height corresponding to about 0.3λ, wherein λ is a wavelength at a center frequency of the antenna.

19. The antenna of claim 18, wherein said AMC wall feed structure is provided having a length corresponding to about 0.5λ, a width corresponding to about 0.4λ, and a height corresponding to about 0.2λ, wherein λ is a wavelength at a center frequency of the antenna.

20. The antenna of claim 1, wherein the AMC wall feed structure comprises AMC wall material formed to selectively permit surface wave currents of predetermined electromagnetic frequencies.

21. The antenna of claim 1, wherein the AMC wall feed structure comprises one or more AMC walls wherein at least one surface of the one or more AMC walls comprises a conductive material and a surface opposite the at least one surface comprises a substantially non-conductive material.

22. The antenna of claim 1, wherein the artificial magnetic conductor (AMC) wall feed structure comprises one or more AMC walls wherein at least one surface of the one or more AMC walls comprises a periodic pattern of conductive material.

* * * * *